US008342466B2

(12) United States Patent
Toshima

(10) Patent No.: US 8,342,466 B2
(45) Date of Patent: Jan. 1, 2013

(54) MOUNTING BRACKET WITH MULTIDIMENSIONAL STABILITY

(75) Inventor: James Toshima, San Diego, CA (US)

(73) Assignees: Sony Corporation, Tokyo (JP); Sony Electronics Inc., Park Ridge, NJ (US)

( * ) Notice: Subject to any disclaimer, the term of this patent is extended or adjusted under 35 U.S.C. 154(b) by 441 days.

(21) Appl. No.: 12/420,319

(22) Filed: Apr. 8, 2009

(65) Prior Publication Data

US 2010/0258693 A1 Oct. 14, 2010

(51) Int. Cl.
*A47B 96/06* (2006.01)

(52) U.S. Cl. ..... 248/220.21; 248/250; 248/300

(58) Field of Classification Search ..... None
See application file for complete search history.

(56) References Cited

U.S. PATENT DOCUMENTS

| | | | | | |
|---|---|---|---|---|---|
| 1,336,971 | A * | 4/1920 | Levene | ..... | 108/109 |
| 1,753,012 | A * | 4/1930 | Levene | ..... | 248/243 |
| 2,653,783 | A * | 9/1953 | Lindsay | ..... | 248/243 |
| 3,669,395 | A * | 6/1972 | Gehrke | ..... | 248/235 |
| 3,837,605 | A * | 9/1974 | Sicard | ..... | 248/235 |
| 4,013,022 | A * | 3/1977 | Walter et al. | ..... | 108/188 |
| 4,154,419 | A * | 5/1979 | Breidenbach | ..... | 248/243 |
| 5,678,797 | A * | 10/1997 | Gogan | ..... | 248/251 |
| 6,109,461 | A * | 8/2000 | Kluge et al. | ..... | 211/90.01 |
| D547,163 | S * | 7/2007 | Xayoiphonh | ..... | D8/363 |
| 2004/0195472 | A1* | 10/2004 | Clover | ..... | 248/127 |
| 2005/0006541 | A1* | 1/2005 | Magnusson et al. | ..... | 248/235 |
| 2007/0251893 | A1 | 11/2007 | Huang | | |
| 2007/0284491 | A1 | 12/2007 | La | | |

OTHER PUBLICATIONS

Sony, "Wall-Mount Bracket", ftp://ftp.vaio-link.com/pub/manuals/consumer/3217571E21.pdf, 2007.

* cited by examiner

*Primary Examiner* — Teri P. Luu
*Assistant Examiner* — Erin W Smith
(74) *Attorney, Agent, or Firm* — John L. Rogitz

(57) ABSTRACT

A support bracket that is stable in multiple dimensions includes a flat support platform and a coupling flange connected to an end of the support platform. A mount flange is connected to an end of the coupling flange, with a hole being formed in the mount flange. An L-shaped hook member extends away from an edge of the mount flange. The hook member is advanced into a slot in a support substrate and slid until it abuts an end of the slot, with the mount flange disposed flush against the support substrate. A fastener is then advanced through the mount flange and into the support substrate. This combination of structure securely holds the bracket on the substrate.

18 Claims, 3 Drawing Sheets

MOUNTING BRACKET WITH MULTIDIMENSIONAL STABILITY

FIELD OF THE INVENTION

The present invention relates generally to mounting brackets with multidimensional stability.

BACKGROUND OF THE INVENTION

Brackets are widely used to mount components to walls and other support substrates. Typically, a single flat flange of a bracket is fastened to the wall, which fails to lend support to the bracket when loaded in all dimensions of stress.

SUMMARY OF THE INVENTION

A "super" bracket with multidimensional stability includes a flat support platform and a coupling flange connected to an end of the support platform and oriented orthogonally to the support platform. A mount flange is connected to an end of the coupling flange and is oriented orthogonally to the coupling flange. The support platform extends from the coupling flange in a first direction and the mount flange extends from the coupling flange in a second direction opposite the first direction. A hole is formed in the mount flange. An L-shaped hook member extends away from an edge of the mount flange and is connected thereto.

With the above in mind, in an aspect a method includes advancing, in a first direction, a hook member of a bracket into a slot in a support substrate and then sliding the hook member in the slot in a second direction orthogonal to the first until the hook member abuts an end of the slot. A mount flange connected to the hook member is disposed flat against the support substrate. A fastener is advanced through a hole formed in the mount flange and engaged with the support substrate to thereby hold the mount flange flush against the support substrate.

In example implementations the coupling flange and platform have the same length as each other in the dimension of the end along which they are connected. A hook leg may join the L-shaped hook member to the mount flange. The leg can be substantially coplanar with the mount flange and substantially orthogonal to the L-shaped hook member. In example embodiments the hook member extends from a first side of the mount flange and the coupling flange extends from a second side of the mount flange opposite the first side. The flanges typically may be flat.

In another aspect, a bracket has a support platform oriented in an x-z plane, a coupling flange connected to the support flange and oriented in a z-y plane, and a mount flange connected to the coupling flange and oriented in an x-y plane. The mount flange is formed with a hole. A hook member is connected to the mount flange and is configured to slide in a slot in a support surface with the mount flange flush against the support surface. With this combination of structure, a fastener can be disposed through the hole into the support surface to hold the bracket, in cooperation with the hook member, securely against the support surface.

The details of the present invention, both as to its structure and operation, can best be understood in-reference to the accompanying drawings, in which like reference numerals refer to like parts, and in which:

DETAILED DESCRIPTION OF THE PREFERRED EMBODIMENT

Figure 1:
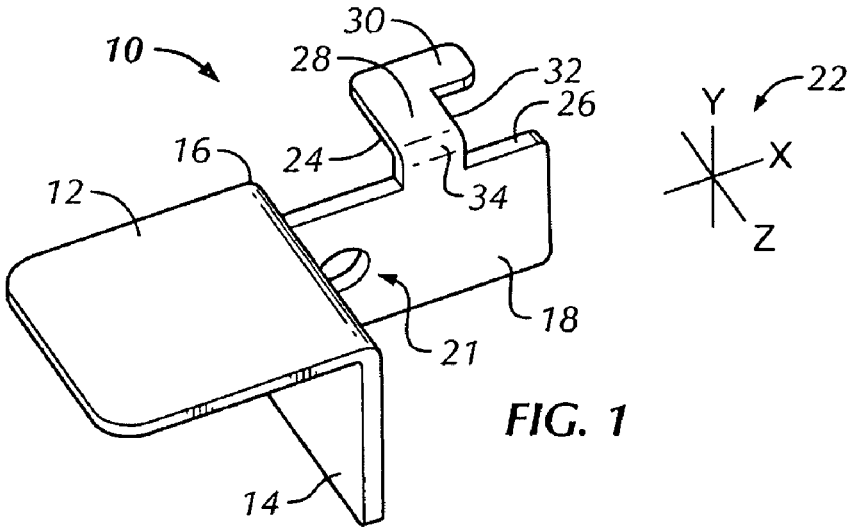
FIG. 1 is a perspective view of an example bracket.
Figure 2:
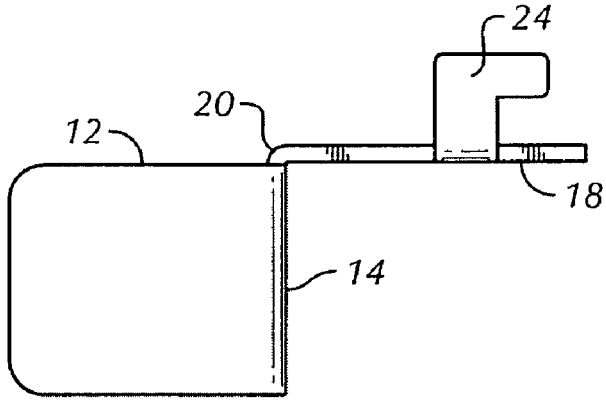
FIG. 2 is a top plan view of the bracket shown in FIG. 1.
Figure 3:
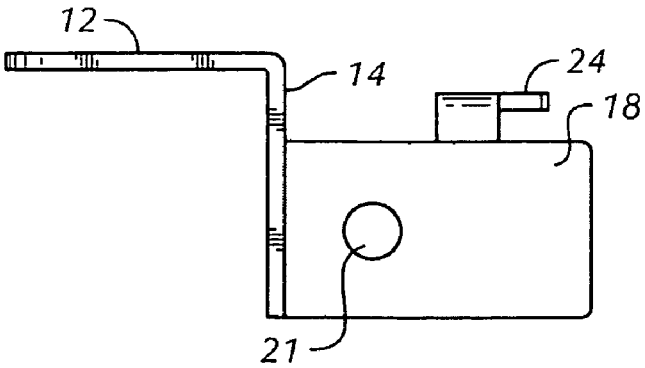
FIG. 3 is a side elevational view of the bracket shown in FIG. 1.
Figure 4:
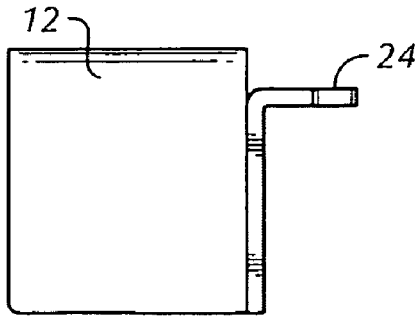
FIG. 4 is a bottom plan view of the bracket shown in FIG. 1.

Initially cross-referencing FIGS. 1-4, a bracket 10 includes a flat support platform 12 and a flat coupling flange 14 connected to an end 16 of the support platform 12 and oriented orthogonally to the support platform 12 as shown; A mount flange 18 is connected to an end 20 of the coupling flange 14 and is oriented orthogonally to the coupling flange. One or more holes 21 through which respective fasteners may extend are formed in the mount flange 18.

Thus, in geometric terms the support platform 12 may be regarded as being oriented in an x-z plane indicated by the Euclidean coordinate lines 22 in FIG. 1. By "oriented" in a plane is meant that the largest flat surface is parallel to the plane. On the other hand, the coupling flange 14 is oriented in the z-y plane and the mount flange 18 is oriented in the x-y plane.

Furthermore, FIG. 1 shows that the support platform 12 extends from the coupling flange 14 in a direction that is opposite to that in which the mount flange 18 extends from the coupling flange 14.

As also shown, hook member 24 extends away from an edge 26 of the mount flange 18 and is connected thereto. The hook member 24 may include a leg element 28 and a foot element 30 orthogonal thereto as shown, with a bight 32 being established in the crook formed by the leg element 28 and foot element 30. In such an example, the hook member 24 is L-shaped. A hook leg 34 may join the hook member 24 to the mount flange 18, and as shown best in FIG. 1 the hook leg 34 may be substantially coplanar with the mount flange 18 and substantially orthogonal to the hook member 24.

It may readily be discerned that the coupling flange 14 and platform 12 may have the same length as each other in the dimension of the end 16 along which they are connected. Also, FIG. 1 perhaps best shows that the hook member 24 laterally extends (relative to the mount flange 18) from a first side of the mount flange 18 while the coupling flange 14 laterally extends from the opposite side of the mount flange 18.

Figure 5:
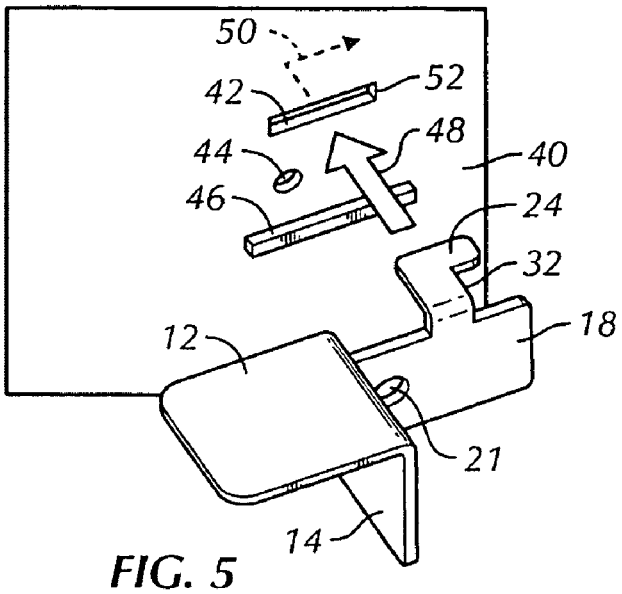
FIGS. 5-7 are perspective views of the bracket illustrating how to mount the bracket on a support substrate.
Figure 6:
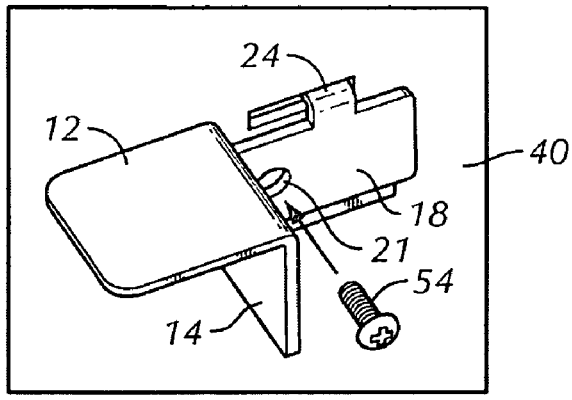
Figure 7:
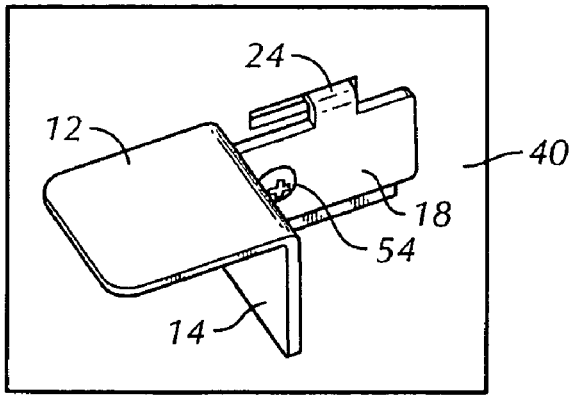

With this structure in mind, attention is turned to FIGS. 5-7. A support substrate 40; which may be established by a vertical wall or shelf or horizontal wall or shelf or other appropriate substrate on which it is desired to mount an object, includes a slit 42. Also, a hole 44 may be formed in the substrate 40 and a small elongated support ledge 46 may also be glued to or otherwise attached to the substrate 40.

A shown by the line 48, the hook member 24 of the bracket 10 is advanced into the slot 42 and then, as indicated by the arrow 50, is slid in the slot 42 in a direction orthogonal to the line 48 until the hook member 24, and in the embodiment shown until the bight 32 formed by the crook in the hook member, abuts the end 52 of the slot 42. The mount flange 18 is disposed flush against the support substrate 40.

Moving to FIG. 6, a fastener 54 such as but not limited to a threaded fastener is advanced through the hole 21 formed in the mount flange 18 and into the hole 44 formed in the substrate 40. The fastener 54 is thus engaged with the support substrate 40 to thereby hold the mount flange 18 flush against the support substrate 40 as shown in FIG. 7. The cooperation of structure between the mount flange 18, fastener 54, and hook member 24 in the slot 42 acts to securely hold the bracket stable in multiple dimensions.

Figure 8:
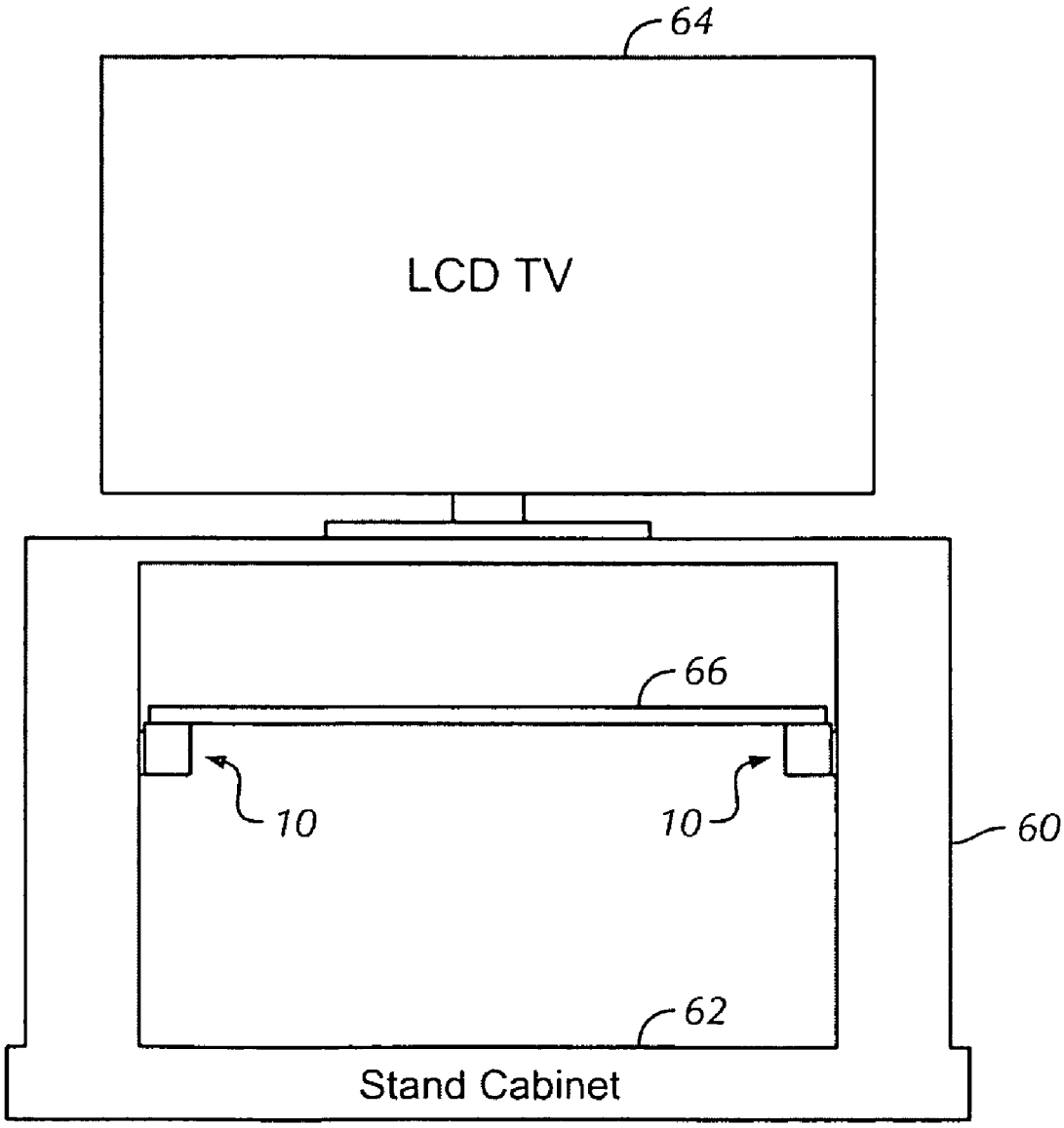
FIG. 8 is an elevational view of two brackets in one non-limiting application.

FIG. 8 shows that in one example non-limiting application, brackets 10 may be mounted to opposite walls 60 of a cabinet stand 62 on which is supported an electronics component 64 such as a TV. A glass shelf 66 may be disposed on the support platforms 12 of the brackets 10.

The bracket 10 may be unitarily molded or cast or otherwise formed out of suitable material such as but not limited to metal such as sheet steel, electrolytically coated, cold-rolled, commercial quality (SECC) steel or the cold-rolled steel known as "SPCC". The steel may be of 1.6 mm thick in non-limiting examples.

While the particular MOUNTING BRACKET WITH MULTIDIMENSIONAL STABILITY is herein shown and described in detail, it is to be understood that the subject matter which is encompassed by the present invention is limited only by the claims.

What is claimed is:

1. Bracket comprising:

flat support platform defining a rectangular major surface;

coupling flange connected along a first edge of the coupling flange to an end of the support platform and oriented orthogonally to the support platform;

mount flange connected to a second edge of the coupling flange and oriented orthogonally to the coupling flange, the first edge being perpendicular to the second edge, the support platform extending from the coupling flange in a first direction and the mount flange extending from the coupling flange in a second direction opposite the first direction, at least one hole being formed in the mount flange; and an L-shaped hook member extending away from an edge of the mount flange and connected thereto, the hook member defining an L-shaped surface that is parallel to the major surface of the support platform.

2. The bracket of claim 1, wherein the coupling flange and platform have the same length as each other in the dimension of the end along which they are connected.

3. The bracket of claim 1, comprising a hook leg joining the L-shaped hook member to the mount flange, the leg being substantially coplanar with the mount flange and substantially orthogonal to the L-shaped hook member.

4. The bracket of claim 1, wherein the hook member extends from a first side of the mount flange and the coupling flange extends from a second side of the mount flange opposite the first side.

5. The bracket of claim 1, wherein the flanges are flat.

6. The bracket of claim 1, further comprising a fastener configured to extend through the hole of the mount flange into a mounting surface.

7. Bracket comprising:

support platform oriented entirely in an x-z plane;

coupling flange connected to the support flange and oriented entirely in a z-y plane;

mount flange connected to the coupling flange and oriented entirely in an x-y plane, the mount flange formed with a hole; and hook member connected to the mount flange and configured to slide in a slot in a support surface with the mount flange flush against the support surface, whereby a fastener can be disposed through the hole into the support surface to hold the bracket, in combination with the hook member, securely against the support surface.

8. The bracket of claim 7, wherein the coupling flange is connected to an end of the support platform and the mount flange is connected to an end of the coupling flange.

9. The bracket of claim 8, wherein the support platform extends from the coupling flange in a first direction and the mount flange extends from the coupling flange in a second direction opposite the first direction.

10. The bracket of claim 9, wherein the hook member is an L-shaped hook member extending away from an edge of the mount flange and connected thereto.

11. The bracket of claim 10, comprising a hook leg joining the L-shaped hook member to the mount flange, the leg being substantially coplanar with the mount flange and substantially orthogonal to the L-shaped hook member.

12. The bracket of claim 11, wherein the hook member extends from a first side of the mount flange and the coupling flange extends from a second side of the mount flange opposite the first side.

13. Bracket comprising:

flat support platform;

coupling flange connected to an end of the support platform and oriented orthogonally to the support platform;

parallelepiped-shaped mount flange having a connected end connected to an end of the coupling flange, the parallelepiped-shaped mount flange being oriented orthogonally to the coupling flange, the parallelepiped-shaped mount flange having a free end distanced from the connected end and parallel thereto with no structure connected to the free end, the support platform extending from the coupling flange in a first direction and the mount flange extending from the coupling flange in a second direction opposite the first direction, the support platform being joined to coupling flange along a first straight edge of the coupling flange, the coupling flange being joined to the parallelepiped-shaped mount flange along a second straight edge of the coupling flange, the first straight edge of the coupling flange being orthogonal to the second straight edge of the coupling flange; and a hook member extending away from an edge of the mount flange and connected thereto, the hook member extending away from the mount flange in a third direction, the support platform extending away from the mount flange in a fourth direction opposite the third direction, the first and second directions being opposite the third and fourth directions.

14. The bracket of claim 13, wherein the coupling flange and platform have the same length as each other in the dimension of the end along which they are connected.

15. The bracket of claim 13, comprising a hook leg joining the hook member to the mount flange, the leg being substantially coplanar with the mount flange and substantially orthogonal to the L-shaped hook member.

16. The bracket of claim 13, wherein the hook member extends from a first side of the mount flange and the coupling flange extends from a second side of the mount flange opposite the first side.

17. The bracket of claim 13, wherein the flanges are flat.

18. The bracket of claim 13, further comprising a fastener configured to extend through the hole of the mount flange into a mounting surface.

* * * * *